US011527205B2

(12) United States Patent
Zhu et al.

(10) Patent No.: US 11,527,205 B2
(45) Date of Patent: Dec. 13, 2022

(54) DISPLAY DRIVING DEVICE AND METHOD WITH LOW POWER CONSUMPTION

(71) Applicant: Raydium Semiconductor Corporation, Hsinchu (TW)

(72) Inventors: YiMing Zhu, Hsinchu (TW); Yung Kun Tsai, Zhubei (TW)

(73) Assignee: RAYDIUM SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/689,105

(22) Filed: Mar. 8, 2022

(65) Prior Publication Data

US 2022/0284858 A1 Sep. 8, 2022

Related U.S. Application Data

(60) Provisional application No. 63/200,448, filed on Mar. 8, 2021.

(51) Int. Cl.
*G09G 3/3258* (2016.01)

(52) U.S. Cl.
CPC ... *G09G 3/3258* (2013.01); *G09G 2310/0205* (2013.01); *G09G 2310/027* (2013.01); *G09G 2310/0297* (2013.01); *G09G 2310/08* (2013.01); *G09G 2330/021* (2013.01); *G09G 2330/023* (2013.01)

(58) Field of Classification Search
CPC ..... G09G 3/3258; G09G 2310/0205; G09G 2310/0297; G09G 2310/08; G09G 2330/021; G09G 2330/023
USPC ..... 345/204
See application file for complete search history.

(56) References Cited

U.S. PATENT DOCUMENTS

| | | | | |
|---|---|---|---|---|
| 6,765,560 | B1 * | 7/2004 | Ozawa | H03M 1/745 345/206 |
| 8,115,704 | B2 * | 2/2012 | Smith | G09G 3/3216 345/82 |
| 8,847,861 | B2 * | 9/2014 | Kimura | G09G 3/2022 345/84 |
| 11,250,752 | B2 * | 2/2022 | Kwak | G09G 3/3648 |
| 2003/0058234 | A1 * | 3/2003 | Kanzaki | G09G 3/3648 345/211 |
| 2005/0264500 | A1 * | 12/2005 | Shirasaki | G09G 3/3225 345/77 |
| 2007/0115231 | A1 * | 5/2007 | Kumeta | G09G 3/3614 345/88 |

(Continued)

*Primary Examiner* — Tom V Sheng
(74) *Attorney, Agent, or Firm* — McClure, Qualey & Rodack, LLP

(57) ABSTRACT

A display driving device and a display driving method with low power consumption are disclosed. The display driving device with low power consumption includes a source driving circuit, a display content detection circuit and a display timing driving circuit. Pixel switches are disposed between an output terminal of source driving circuit and sub-pixels of panel. The display timing driving circuit is coupled to the source driving circuit and display content detection circuit and used to change driving order according to display information detected by the display content detection circuit to control turn-on times of at least two pixel-switches of the pixel-switches to overlap each other to simultaneously drive at least two sub-pixels of the sub-pixels corresponding to the at least two pixel-switches.

16 Claims, 10 Drawing Sheets

(56) References Cited

U.S. PATENT DOCUMENTS

| | | | | |
|---|---|---|---|---|
| 2008/0100599 | A1* | 5/2008 | Kinoshita | G09G 3/3688 345/204 |
| 2009/0207119 | A1* | 8/2009 | Han | G09G 3/3659 345/98 |
| 2015/0325204 | A1* | 11/2015 | Lin | G09G 5/10 345/102 |
| 2017/0261828 | A1* | 9/2017 | Noma | G09G 3/3677 |
| 2020/0074953 | A1* | 3/2020 | Takahashi | G09G 3/3677 |
| 2021/0303063 | A1* | 9/2021 | Choi | G09G 3/2003 |
| 2021/0312860 | A1* | 10/2021 | Kim | G09G 3/32 |
| 2022/0270543 | A1* | 8/2022 | Zhang | G09G 3/3275 |

* cited by examiner

DISPLAY DRIVING DEVICE AND METHOD WITH LOW POWER CONSUMPTION

BACKGROUND OF THE INVENTION

1. Field of the Invention

The invention relates to a display driver; in particular, to a display driving device and method with low power consumption.

2. Description of the Prior Art

Active-Matrix Organic Light-Emitting Diode (AMOLED) display panel has advantages of power saving, excellent dark-state performance, fast response speed due to its self-luminous characteristics, and its self-luminescence is current driven, so its luminous brightness will be proportional to the current. The AMOLED display panel may include a plurality of sub-pixels, and each sub-pixel corresponds to its dedicated pixel circuit to control the driving current, so as to achieve the purpose of changing different display brightness.

To refresh a panel, a gate signal of the display panel selects one row of a frame, and the source driving line of the display driver integrated circuit (DDIC) provides a voltage signal with display information to each sub-pixel in a row of the frame to complete a row data update, and the gate signal and the source signal update each row in sequence until the entire frame is updated.

At early stages, the conventional DDIC design is that each red (R), green (G) and blue (B) sub-pixel of the display panel is correspondingly connected to one source driving line. For example, if the RGB resolution of the display panel is 480, there should be 1440 source driving lines disposed on the DDIC; as a result, the size of the DDIC becomes larger and the chip-on-film (COF) tape connecting the display panel with the DDIC becomes wider, which is not conducive to its mechanism design and cost control.

In order to solve this problem, as shown in FIG. 1, a plurality of sub-pixels R1, G1, B1, R2, G2 and B2 of the display panel share the same source driving line Si in the DDIC with improved design, thereby the number of the source drive lines required for the DDIC can be greatly reduced.

As shown in FIG. 2, during the pre-charging period (from the time t0 to the time t1), the switch control signals MUX1~MUX6 control the pixel switches SW1~SW6 to perform pre-charging. It should be noted that, during the pre-charging period (from the time t0 to the time 0), no matter what information is displayed on the screen of the display panel, all sub-pixels will be reset to a specific voltage. During the display data writing period (from the time t2 to the time t8), the display data needs to be time-divisionally written to the sub-pixels of the display panel. For example, the display data is written to the sub-pixel R1 during the period from the time t2 to the time t3, the display data is written to the sub-pixel G1 during the period from the time t3 to the time t4, the display data is written to the sub-pixel B1 during the period from the time t4 to the time t5, the display data is written to the sub-pixel R2 during the period from the time t5 to the time t6, the display data is written to the sub-pixel G2 during the period from the time t6 to the time t7, and the display data is written to the sub-pixel B2 during the period during the time t7 to the time t8.

Although the driving voltages used to drive the six sub-pixels are all the same, its driving timing is still that the display data is time-divisionally written to the six sub-pixels of the display panel in order. Therefore, during the display data writing period (from the time t2 to the time t8), the driving circuit remains in the turn-on state and the power consumption of the system cannot be effectively reduced, which needs to be further improved.

SUMMARY OF THE INVENTION

Therefore, the invention provides a display driving device and method with low power consumption to solve the above-mentioned problems of the prior arts.

A preferred embodiment of the invention is a display driving device with low power consumption. In this embodiment, the display driving device with low power consumption includes a source driving circuit, a display content detection circuit and a display timing driving circuit. An output terminal of the source driving circuit is coupled to a plurality of sub-pixels of a display panel respectively, wherein a plurality of pixel switches is disposed between the output terminal and the sub-pixels respectively. The source driving circuit is coupled to the display timing driving circuit and a power control circuit respectively. The display content detection circuit is coupled to the display timing driving circuit and used to detect the display information. The display timing driving circuit is coupled to the source driving circuit and the display content detection circuit and used to change a driving order according to display information detected by the display content detection circuit to control turn-on times of at least two pixel-switches overlap each other to drive at least two sub-pixels simultaneously.

In an embodiment, the source driving circuit writes a specific voltage to the at least two sub-pixels which are turned on simultaneously according to the display information.

In an embodiment, the power control circuit is coupled to the source driving circuit and the display timing driving circuit respectively and used to turn off the power or change bias voltage or driving strength to reduce power consumption.

In an embodiment, the turn-on times of the at least two pixel switches partially overlap.

In an embodiment, the turn-on times of the at least two pixel switches completely overlap.

In an embodiment, the turn-on times of the plurality of pixel switches overlap each other.

In an embodiment, the display driving device further includes a partition driving circuit. The display panel includes a plurality of display areas. The partition driving circuit controls the plurality of display areas to have the same driving timing, and the display timing driving circuit controls turn-on times of at least two pixel switches corresponding to at least two sub-pixels in at least one display area overlap each other.

In an embodiment, the display driving device further includes a partition driving circuit. The display panel includes a plurality of display areas. The partition driving circuit controls the plurality of display areas to have different driving timings, and the display timing driving circuit controls turn-on times of at least two pixel switches corresponding to at least two sub-pixels in at least one display area overlap each other.

Another preferred embodiment of the invention is a display driving method with low power consumption. In this embodiment, the method includes steps of: coupling an output terminal of a source driving circuit to a plurality of sub-pixels of a display panel respectively; disposing a plurality of pixel switches between the output terminal and the plurality of sub-pixels respectively; and the source driving circuit is coupled to a display timing driving circuit and a power control circuit respectively, the display timing driving circuit is coupled to the source driving circuit and a display content detection circuit respectively, the display timing driving circuit changes a driving order according to the display information to control the turn-on times of at least two pixel switches overlap each other to drive at least two sub-pixels simultaneously.

In an embodiment, the method further includes a step of: writing a specific voltage to the at least two sub-pixels which are turned on simultaneously according to the display information.

In an embodiment, the method further includes a step of: the power control turning off the power or changing bias voltage or driving strength to reduce power consumption.

In an embodiment, the turn-on times of the at least two pixel switches partially overlap.

In an embodiment, the turn-on times of the at least two pixel switches completely overlap.

In an embodiment, the turn-on times of the plurality of pixel switches overlap each other.

In an embodiment, the display panel includes a plurality of display areas. The display driving method controls the plurality of display areas to have the same driving timing, and the display timing driving circuit controls turn-on times of at least two pixel switches corresponding to at least two sub-pixels in at least one display area overlap each other.

In an embodiment, the display panel includes a plurality of display areas. The display driving method controls the plurality of display areas to have different driving timings, and the display timing driving circuit controls turn-on times of at least two pixel switches corresponding to at least two sub-pixels in at least one display area overlap each other.

Compared to the prior art, the display driving device and display driving method with low power consumption proposed by the invention simultaneously write the display data to at least two sub-pixels driven by the same driving voltage to finish the display data writing early and turn off a part of subcircuits of the DDIC. In addition, its driving waveform and timing can be adjusted arbitrarily and can be matched with the driving timing of the pre-charging compensation, and the entire display panel can be divided into multiple display blocks and each display block can have the same driving timing or different driving timings, so that the power consumption can be effectively reduced.

The advantage and spirit of the invention may be understood by the following detailed descriptions together with the appended drawings.

BRIEF DESCRIPTION OF THE APPENDED DRAWINGS

Figure 6:
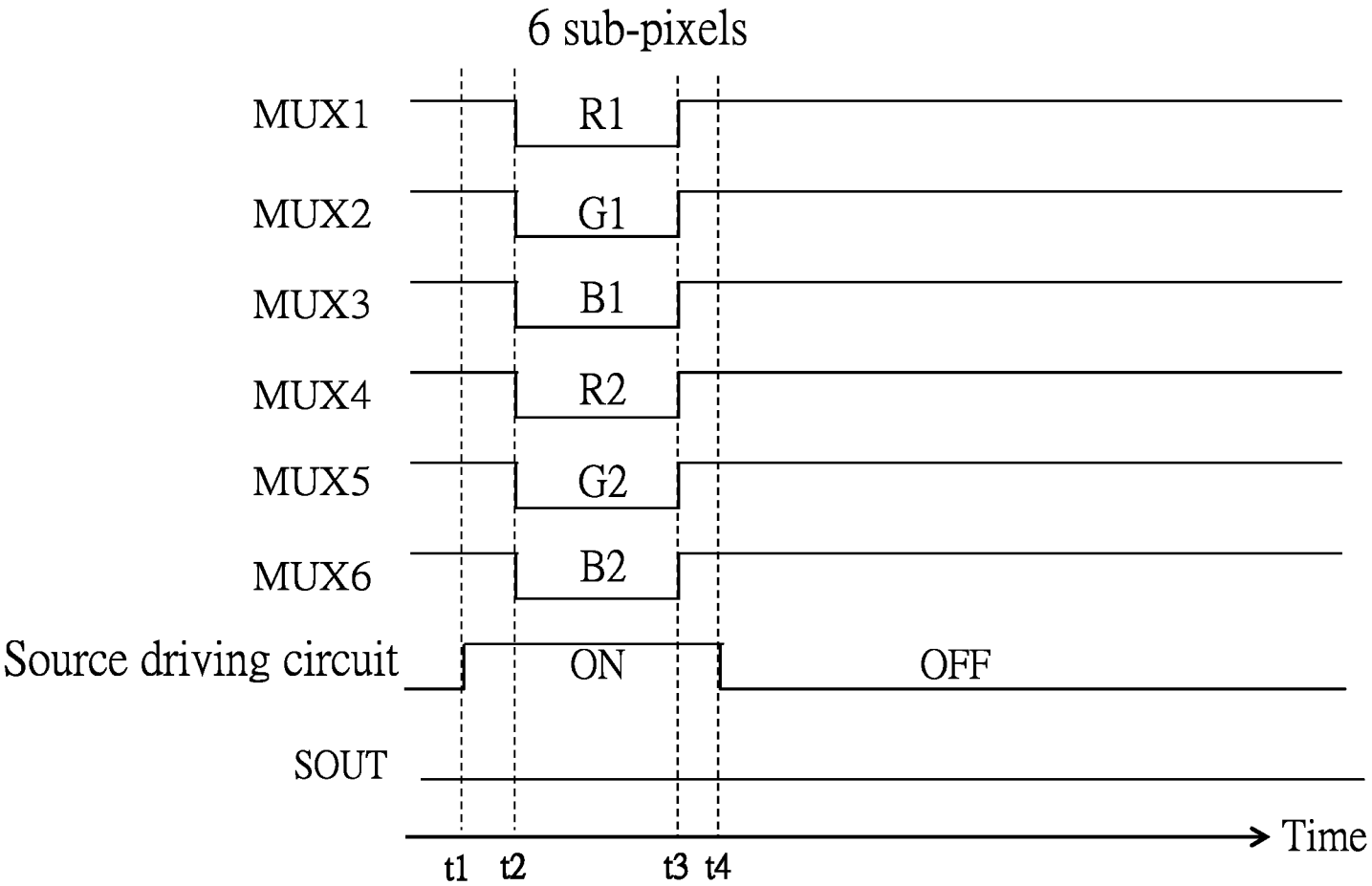
Figure 7:
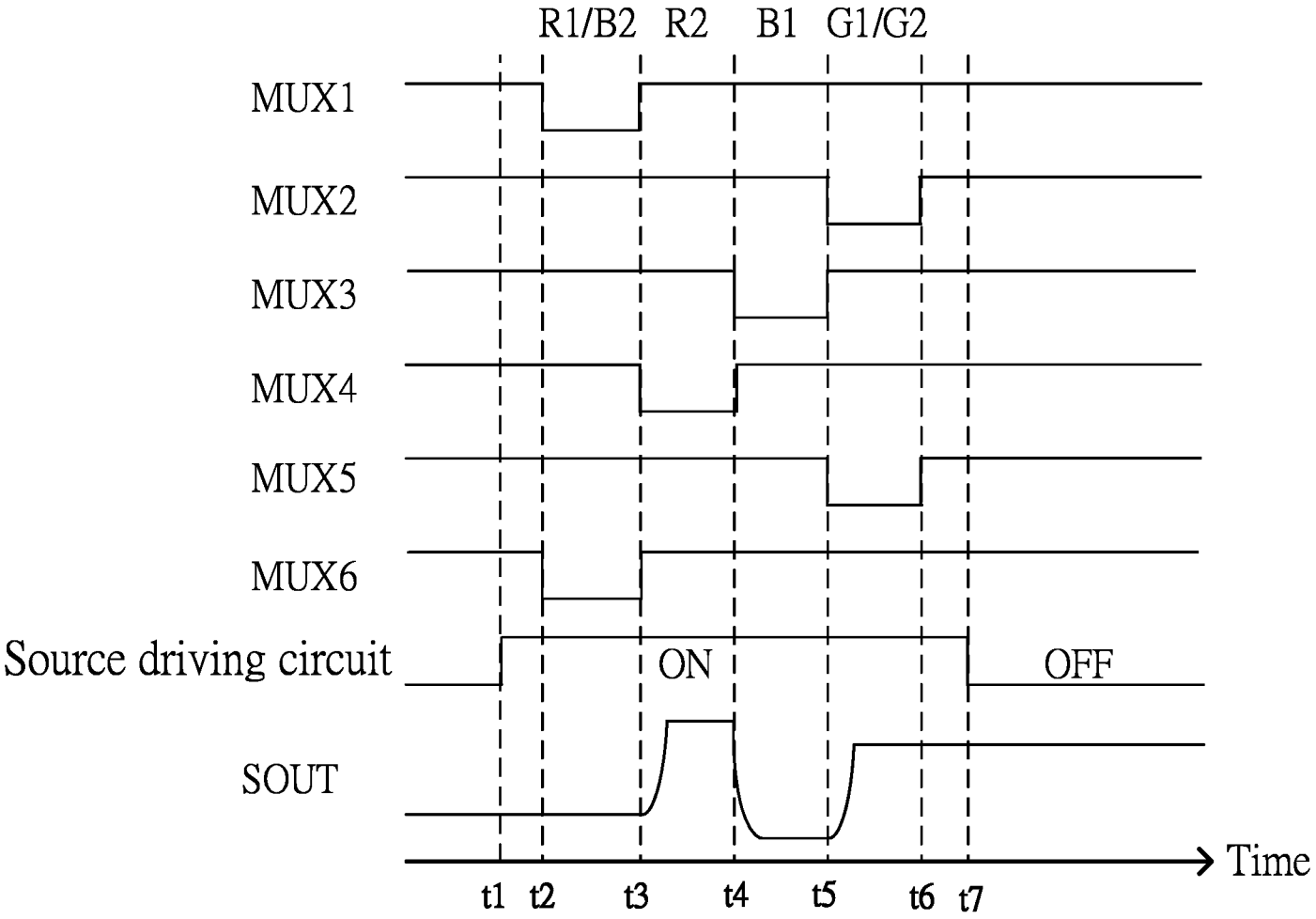
Figure 8:
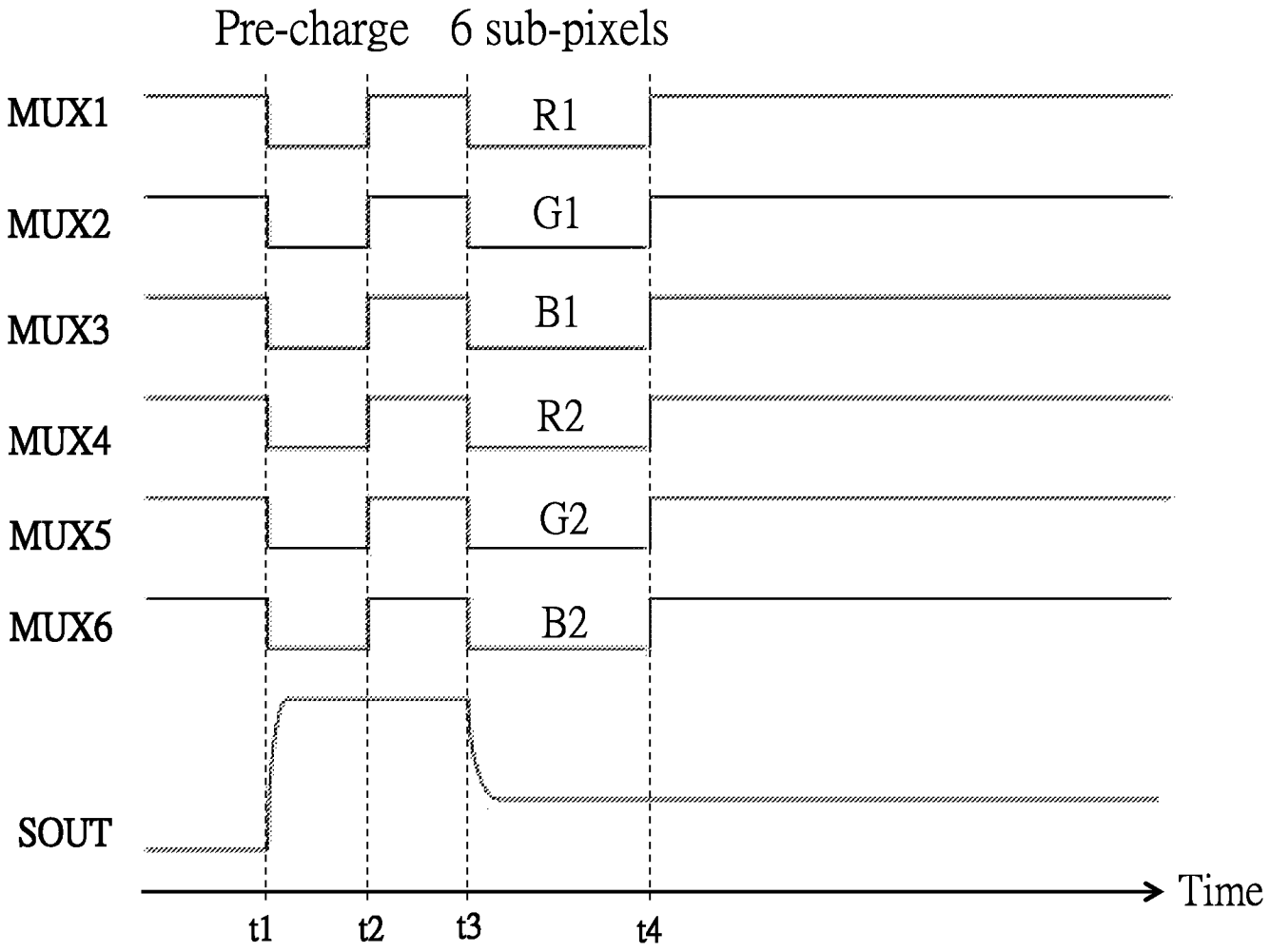

FIG. 6~FIG. 8 illustrate timing diagrams showing different embodiments of the display driving device driving the sub-pixels in the invention respectively.

Figure 9:
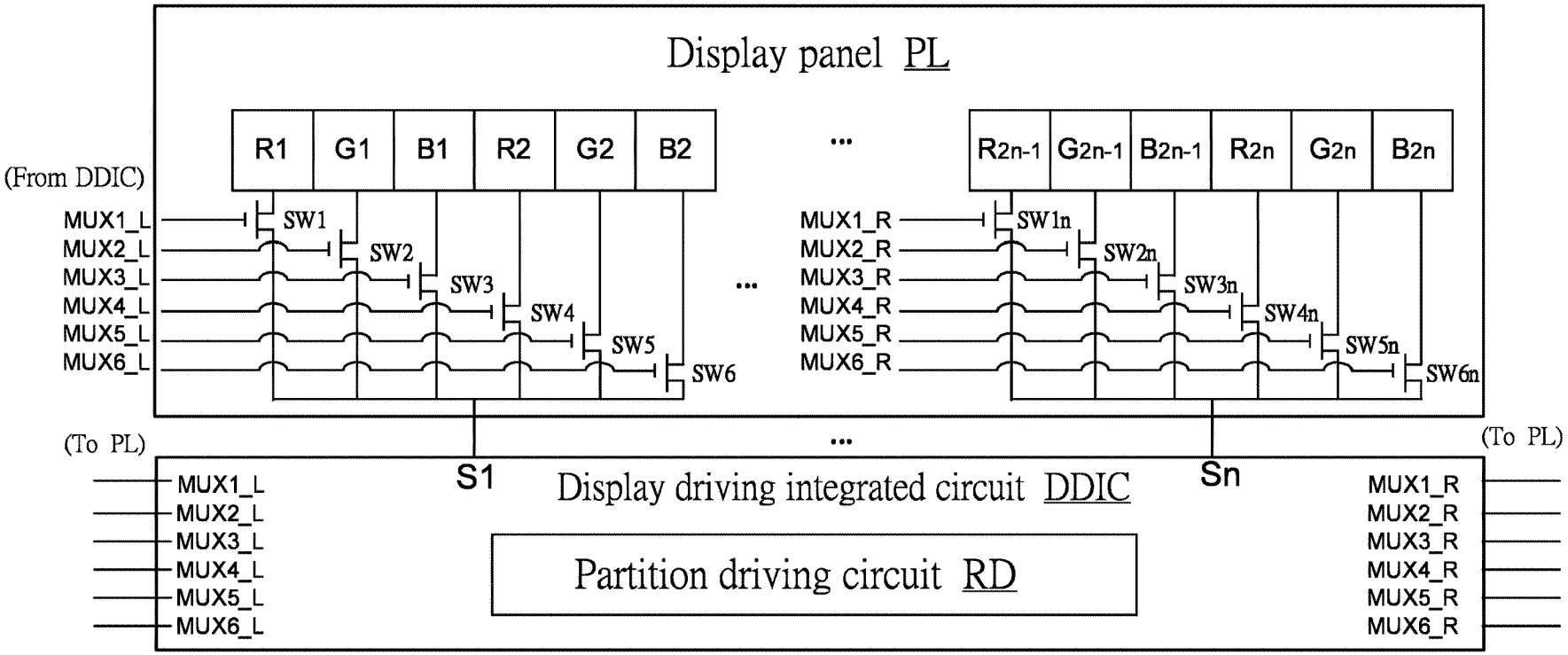

FIG. 9 illustrates a schematic diagram showing that the display driving device drives different display areas of the display panel in the invention.

Figure 10:
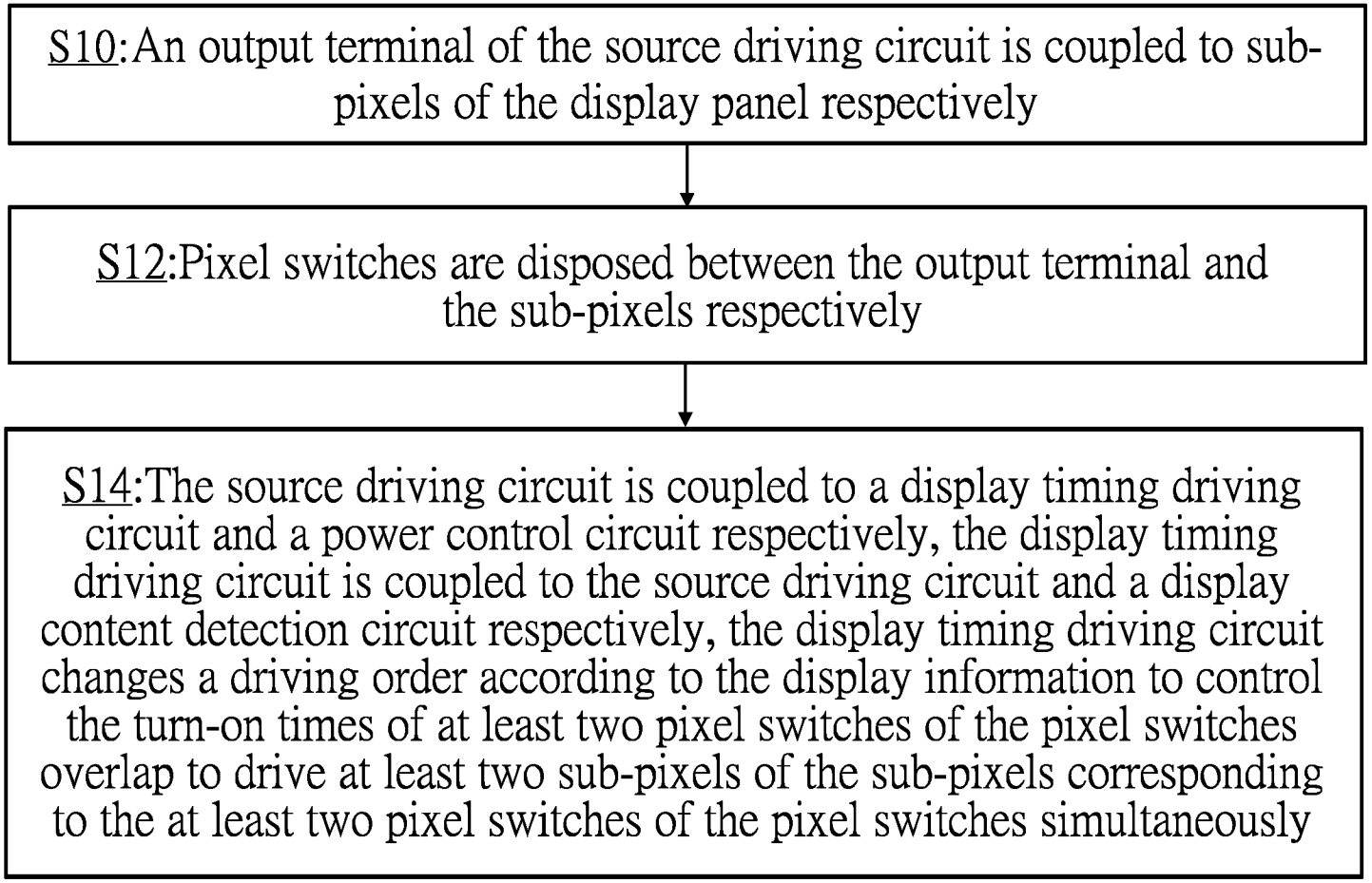

FIG. 10 illustrates a flowchart of a display driving method with low power consumption in another embodiment of the invention.

DETAILED DESCRIPTION OF THE INVENTION

A preferred embodiment of the invention is a display driving device with low power consumption. In this embodiment, the display panel can be an active-matrix organic light-emitting diode (AMOLED) display panel or other various types of display panels, and there is no specific limitation. When the display panel is driven by the display driving device with low power consumption, its power consumption can be significantly reduced compared with the prior art, but not limited to this.

Figure 3:
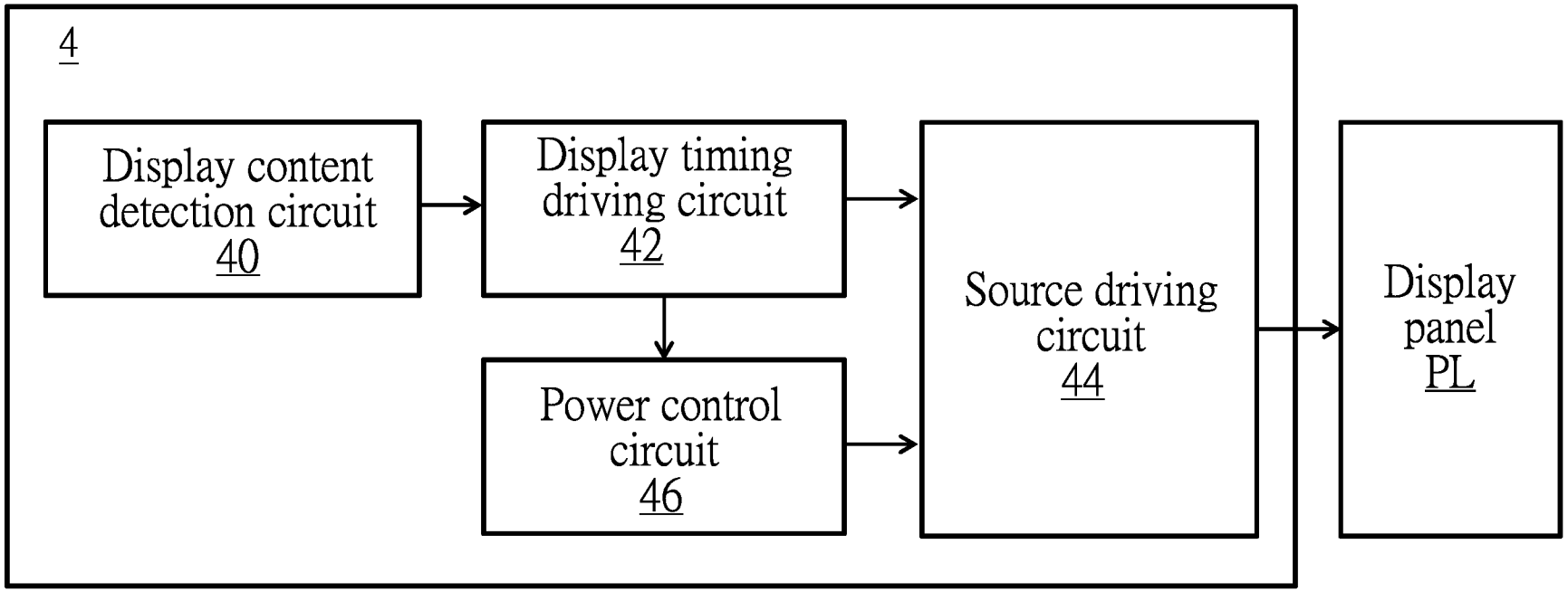
FIG. 3 illustrates a functional block diagram of the display driving device with low power consumption in an embodiment of the invention.

Please refer to FIG. 3. FIG. 3 illustrates a functional block diagram of a display driving device 4 with low power consumption in this embodiment. As shown in FIG. 3, the display driving device 4 with low power consumption is coupled to a display panel PL and used to drive the display panel PL to display images.

The display driving device 4 with low power consumption includes a display content detection circuit 40, a display timing driving circuit 42, a source driving circuit 44 and a power control circuit 46. The display content detection circuit 40 is coupled to the display timing driving circuit 42. The display timing driving circuit 42 is coupled to the source driving circuit 44 and the power control circuit 46 respectively. The source driving circuit 44 is coupled to the display timing driving circuit 42, the power control circuit 46 and the display panel PL respectively. The power control circuit 46 is coupled to the display timing driving circuit 42 and the source driving circuit 44 respectively.

Figure 1:
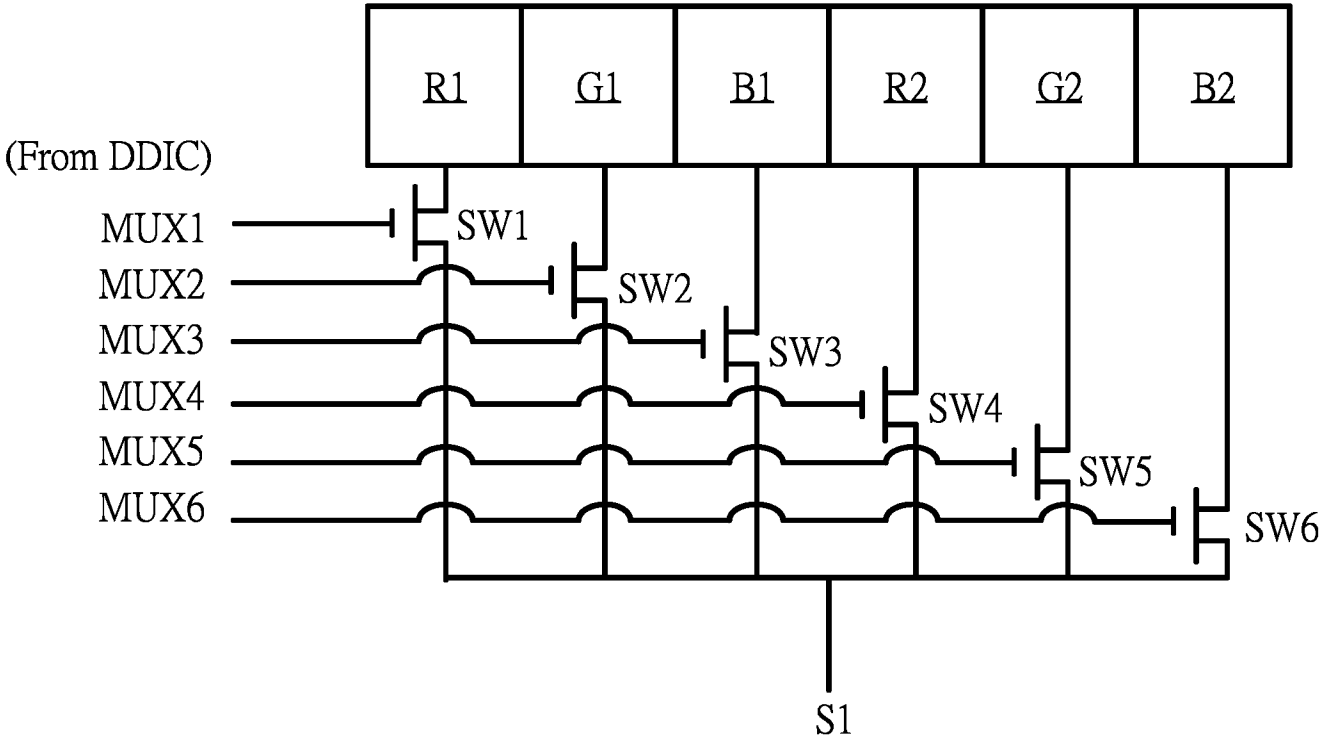
FIG. 1 (PRIOR ART)
FIG. 1 illustrates a schematic diagram showing that one source driving line is coupled to the display panel in the prior art.
Figure 2:
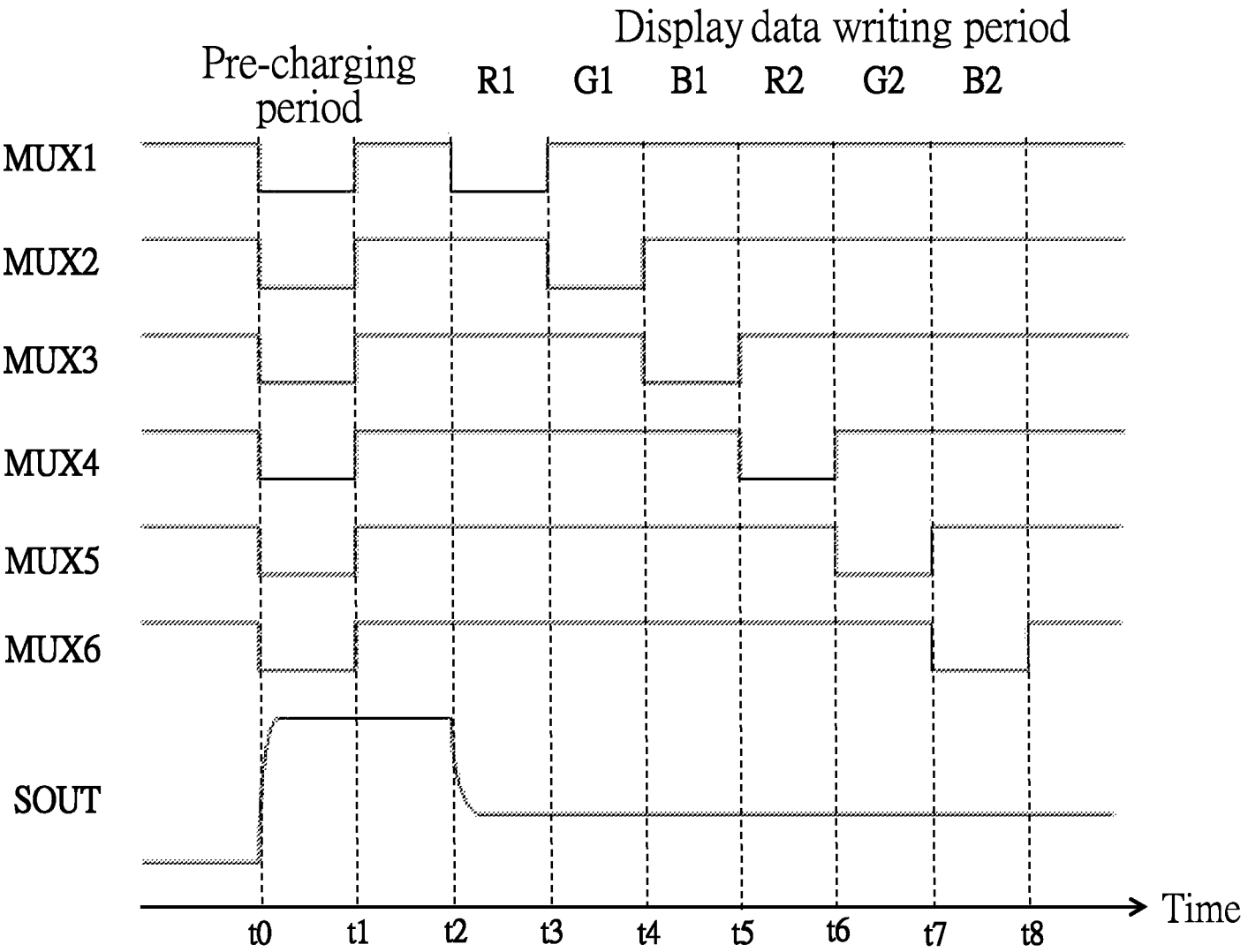
FIG. 2 (PRIOR ART)
FIG. 2 illustrates a timing diagram showing that pre-charging is performed on the sub-pixels of the display panel in the prior art.

In this embodiment, the output terminal of the source driving circuit 44 is coupled to a plurality of sub-pixels (for example, six sub-pixels R1, G1, B1, R2, G2, B2 in FIG. 1, but not limited to this) of the display panel PL respectively. A plurality of pixel switches (for example, six switches SW1~SW6 corresponding to the six sub-pixels R1, G1, B1, R2, G2, B2 in FIG. 1 respectively, but not limited to this) can be correspondingly disposed between the output terminal of the source driving circuit 44 and the plurality of sub-pixels.

The display content detection circuit 40 is used to detect the change of the display information. The display timing driving circuit 42 is used to change driving timing (for example, driving waveforms of the switch control signals MUX1~MUX6 in FIG. 4) according to the display information detected by the display content detection circuit 40, so as to control turn-on times of at least two pixel switches (such as switches SW1 and SW4~SW5, switches SW2~SW3, but not limited to this) corresponding to the same driving voltage of the plurality of pixel switches to overlap each other (actually it can be completely or partially overlapped) and further control the lengths of the turn-on times.

Figure 4:
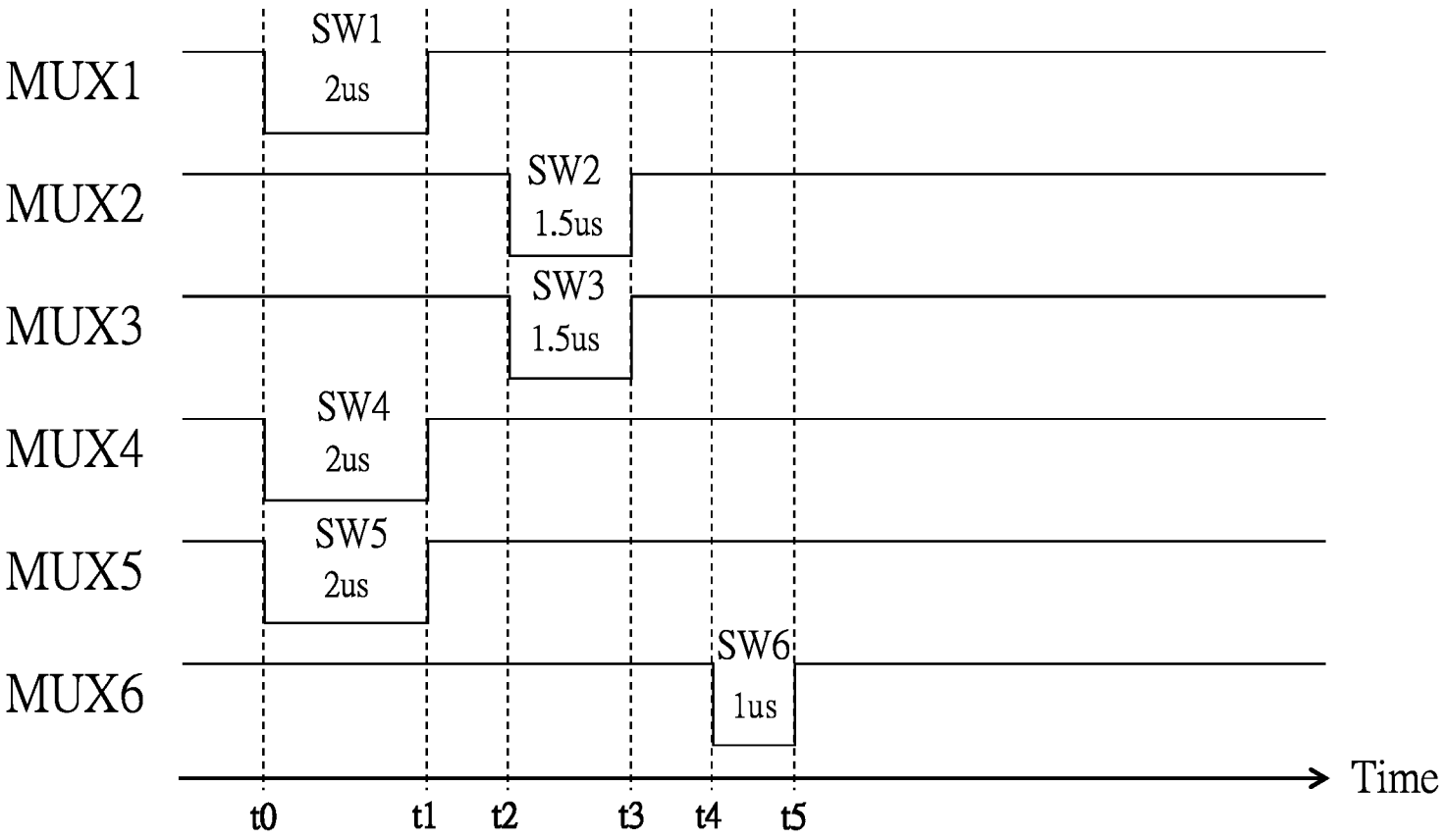
FIG. 4 illustrates a timing diagram of controlling turn-on times of at least two pixel switches corresponding to the same driving voltage overlap each other and further controlling the lengths of the turn-on times.

It should be noted that, as shown in FIG. 4, the turn-on time length is controlled because the original writing time required for only one sub-pixel at one time is short (for example, 1 us), but now the writing time required for multiple sub-pixels at one time (For example, switches SW1 and SW4~SW5, switches SW2~SW3, but not limited to this) becomes longer (such as 1.5 us or 2 us) because the load becomes heavier. However, it will still finish the display data writing 1.5 us earlier than the conventional method of writing six sub-pixels in order.

When the turn-on times of the at least two pixel switches (for example, the switches SW1~SW6, but not limited to this) overlap each other, the driving voltage provided by the source driving circuit 44 according to the display information will drive at least two sub-pixels corresponding to the at least two pixel switches (for example, the sub-pixels R1, G1, B1, R2, G2 and B2 corresponding to the switches SW1~SW6, but not limit to this) of the plurality of sub-pixels at the same time. The power control circuit 46 is coupled to the source driving circuit 44 and the display timing driving circuit 42 respectively and used to turn off the power or change bias voltage and driving strength after the writing operation is completed to reduce power consumption.

Figure 5:
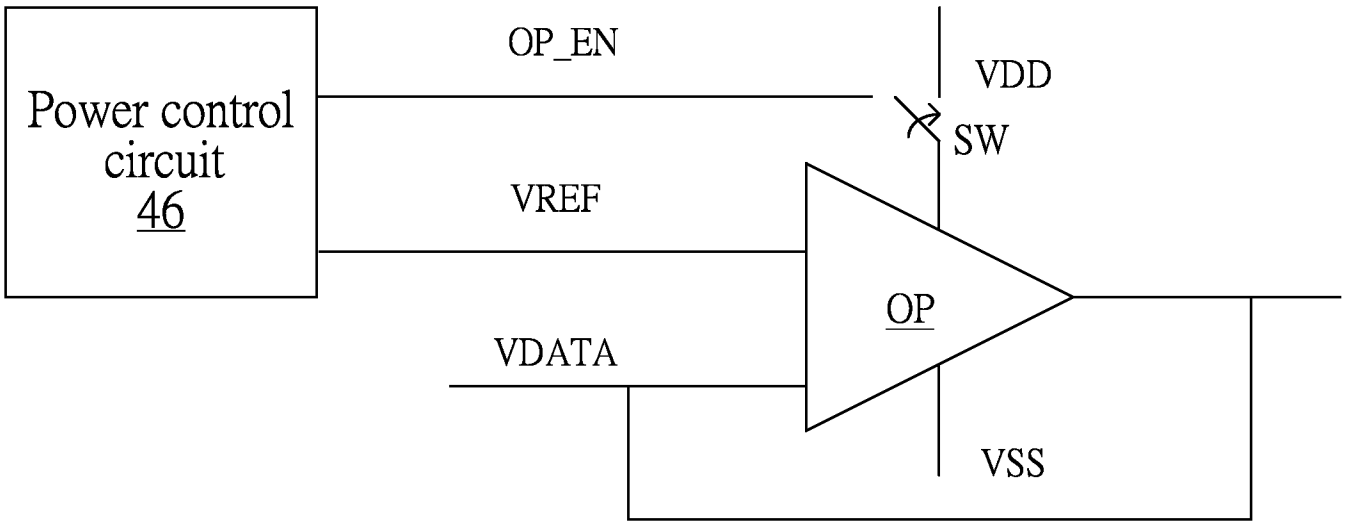
FIG. 5 illustrates a schematic diagram showing that the power control circuit is used to turn off the power or change bias voltage or driving strength.

For example, as shown in FIG. 5, the power control circuit 46 can provide the enable signal OP_EN to control whether the switch SW is conducted or not to turn on or off the operational amplifier circuit OP, or the power control circuit 46 can change bias voltage or driving strength through the reference voltage VREF, but not limited to this.

Next, please refer to FIG. 6~FIG. 8. FIG. 6~FIG. 8 illustrate timing diagrams of different embodiments of the display driving device 4 with low power consumption for driving a plurality of sub-pixels of the display panel PL in the invention respectively.

As shown in FIG. 6, in this embodiment, it is assumed that the driving voltages of the six sub-pixels R1, G1, B1, R2, G2 and B2 of the display panel PL are the same, then the six switch control signals MUX1~MUX6 provided by the source driving circuit 44 can be at low-level during a period from the time t2 to the time t3 simultaneously to control the six pixel switches SW1~SW6 corresponding to the six sub-pixels R1, G1, B1, R2, G2 B2 respectively turned on during the period from the time t2 to the time t3 simultaneously, so that the source driving circuit 44 only needs to be kept in the turn-on state during the period from the time t1 to the time t4. Therefore, compared with that the six pixel switches SW1~SW6 needs to be time-dividedly turned on in sequence and the source driver circuit needs to be kept in the turn-on state for a long time in the prior art, this embodiment can indeed greatly shorten the turn-on time required by the source driving circuit 44, thereby effectively reducing power consumption.

As shown in FIG. 7, in this embodiment, it is assumed that the driving voltages of the sub-pixels R1 and B2 of the display panel PL are the same and the driving voltages of the sub-pixels G1 and G2 are the same, the switch control signals MUX1 and MUX6 provided by the source driving circuit 44 can be at low-level during the period from the time t2 to the time t3 simultaneously to control the pixel switches SW1 and SW6 corresponding to the sub-pixels R1 and B2 respectively turned on during the period from the time t2 to the time t3 simultaneously, and the switch control signals MUX2 and MUX5 can be at low-level during the period from the time t5 to the time t6 simultaneously to control the pixel switches SW2 and SW5 corresponding to the sub-pixels G1 and G2 respectively turned on during the period from the time t5 to the time t6 simultaneously. As for the switch control signal MUX4 can be at low-level during the period from the time t3 to the time t4 to control the pixel switch SW4 corresponding to the sub-pixel R2 turned on during the period from the time t3 to the time t4 and the switch control signal MUX3 can be at low-level during the period from the time t4 to the time t5 to control the pixel switch SW3 corresponding to the sub-pixel B1 turned on during the period from the time t4 to the time t5. By doing so, the source driving circuit 44 only needs to be maintained in the turn-on state during the period from the time t1 to the time t7. Therefore, compared with that the six pixel switches SW1~SW6 needs to be time-dividedly turned on in sequence and the source driver circuit needs to be kept in the turn-on state for a long time in the prior art, this embodiment can indeed greatly shorten the turn-on time required by the source driving circuit 44, thereby effectively reducing power consumption.

In practical applications, in addition to the above switching driving waveforms of the pixel switches SW1~SW6, other arbitrary waveform changes can be also matched according to the actual situation; for example, the pre-charging waveform can be added before the switch driving waveform (as shown in FIG. 8, the pre-charging waveform is added during the period from the time t1 to the time t2, but not limited to this), or the driving polarity can be reversed, or the time difference between the pre-charging waveform and the turn-on time of the first pixel switch can be changed, or the turn-on sequence of the pixel switches can be changed, etc., but not limited to this.

In another embodiment, the display panel PL can include a plurality of display areas, and the display panel PL can be divided into the plurality of display areas up and down or divided into the plurality of display areas left and right, but not limited to this.

In practical applications, the display driving device can further include a partition driving circuit (for example, the display driving integrated circuit DDIC in FIG. 9 includes a partition driving circuit RD, but not limited to this) to control the plurality of display areas have the same driving timing. The display timing driving circuit 42 will control the on-times of at least two pixel switches corresponding to at least two sub-pixels in at least one display area to overlap each other (actually can be completely overlapped or partially overlapped) according to the display information, but not limited to this.

Similarly, the partition driving circuit can also control the plurality of display areas to have different driving timings. The display timing driving circuit 42 will control the on-times of at least two pixel switches corresponding to at least two sub-pixels in at least one display area to overlap each other (actually can be completely overlapped or partially overlapped) according to the display information, but not limited to this.

In other words, no matter how many display areas the display panel PL is divided into, there will be two or more sub-pixel switches corresponding to the same driving voltage in the display panel PL whose turn-on times will completely overlap or partially overlap to achieve the purpose of reducing power consumption.

For example, as shown in FIG. 9, it is assumed that the display panel PL includes n display areas, the partition driving circuit RD in the display driving integrated circuit DDIC can drive the n display areas of the display panel PL with the same driving timing or different driving timings. Assuming that the first display area includes sub-pixels R1, G1, B1, R2, G2, B2, . . . , the n-th display area includes sub-pixels R2$n$−1, G2$n$−1, B2$n$−1, R2$n$, G2$n$, B2$n$, the switch control signals MUX1_L~MUX6_L from the display driving integrated circuit DDIC are used to control the pixel switches SW1~SW6 corresponding to the sub-pixels R1, G1, B1, R2, G2, B2 of the first display area, so that the turn-on times of at least two pixel switches in the pixel switches SW1~SW6 overlap each other, or the switch control signals MUX1_R~MUX6_R from the display driving integrated circuit DDIC are used to control the pixel switches SW1$n$~SW6$n$ corresponding to the sub-pixels R2$n$−1, G2$n$−1, B2$n$−1, R2$n$, G2$n$ and B2$n$ of the nth display area, so that the turn-on times of at least two pixel switches in the pixel switches SW1~SW6 overlap each other, but not limited to this.

It should be noted that although the above-mentioned embodiments are described by taking six sub-pixels and their corresponding six-pixel switches as an example, the number of sub-pixels and their corresponding pixel switches in practical applications can be determined according to actual needs and not limited to the above-mentioned embodiments.

Another preferred embodiment of the invention is a display driving method with low power consumption. It should be noticed that when the display panel is driven by the display driving method in this embodiment, its power consumption can be effectively reduced compared to the prior art, but not limited to this.

Please refer to FIG. 10. FIG. 10 illustrates a flowchart of the display driving method with low power consumption in this embodiment. As shown in FIG. 10, the display driving method with low power consumption can include following steps:

Step S10: an output terminal of the source driving circuit is coupled to sub-pixels of the display panel respectively;

Step S12: pixel switches are disposed between the output terminal and the sub-pixels respectively; and Step S14: the source driving circuit is coupled to a display timing driving circuit and a power control circuit respectively, the display timing driving circuit is coupled to the source driving circuit and a display content detection circuit respectively, the display timing driving circuit changes a driving order according to the display information to control the turn-on times of at least two pixel switches of the pixel switches overlap to drive at least two sub-pixels of the sub-pixels corresponding to the at least two pixel switches of the pixel switches simultaneously.

In different embodiments, the method can further write a specific voltage to the at least two sub-pixels which are turned on simultaneously according to the display information, but not limited to this; the power control circuit can turn off the power or change bias voltage or driving strength to reduce power consumption, but not limited to this; the turn-on times of the at least two pixel switches can partially overlap or completely overlap, but not limited to this; all turn-on times of the plurality of pixel switches can overlap each other, but not limited to this.

In an embodiment, the display panel can include a plurality of display areas. The display driving method can control the plurality of display areas to have the same driving timing. The display timing driving circuit controls turn-on times of at least two pixel switches corresponding to at least two sub-pixels in at least one display area overlap each other, but not limited to this.

In another embodiment, the display driving method can control the plurality of display areas to have different driving timings. The display timing driving circuit can control turn-on times of at least two pixel switches corresponding to at least two sub-pixels in at least one display area overlap each other.

Compared to the prior art, the display driving device and display driving method with low power consumption proposed by the invention simultaneously write the display data to at least two sub-pixels driven by the same driving voltage to finish the display data writing early and turn off a part of subcircuits of the DDIC. In addition, its driving waveform and timing can be adjusted arbitrarily and can be matched with the driving timing of the pre-charging compensation, and the entire display panel can be divided into multiple display blocks and each display block can have the same driving timing or different driving timings, so that the power consumption can be effectively reduced.

What is claimed is:

1. A display driving device with low power consumption, comprising:

a source driving circuit, an output terminal of the source driving circuit being coupled to a plurality of sub-pixels of a display panel respectively, wherein a plurality of pixel switches is disposed between the output terminal and the plurality of sub-pixels respectively, and the source driving circuit is coupled to a display timing driving circuit and a power control circuit respectively;

a display content detection circuit, coupled to the display timing driving circuit, for detecting display information; and the display timing driving circuit, coupled to the source driving circuit and the display content detection circuit respectively, for changing a driving order according to the display information detected by the display content detection circuit to control turn-on times of at least two pixel switches overlap each other to drive at least two sub-pixels simultaneously.

2. The display driving device of claim 1, wherein the source driving circuit writes a specific voltage to the at least two sub-pixels which are turned on simultaneously according to the display information.

3. The display driving device of claim 1, wherein the power control circuit is coupled to the source driving circuit and the display timing driving circuit respectively and used to turn off the power or change bias voltage or driving strength to reduce power consumption.

4. The display driving device of claim 1, wherein the turn-on times of the at least two pixel switches partially overlap.

5. The display driving device of claim 1, wherein the turn-on times of the at least two pixel switches completely overlap.

6. The display driving device of claim 1, wherein the turn-on times of the plurality of pixel switches overlap each other.

7. The display driving device of claim 1, wherein the display driving device further comprises a partition driving circuit, the display panel comprises a plurality of display areas, the partition driving circuit controls the plurality of display areas to have the same driving timing, and the display timing driving circuit controls turn-on times of the at least two pixel switches corresponding to at least two sub-pixels in at least one display area overlap each other.

8. The display driving device of claim 1, wherein the display driving device further comprises a partition driving circuit, the display panel comprises a plurality of display areas, the partition driving circuit controls the plurality of display areas to have different driving timings, and the display timing driving circuit controls turn-on times of at least two pixel switches corresponding to at least two sub-pixels in at least one display area overlap each other.

9. A display driving method with low power consumption, comprising steps of:

coupling an output terminal of a source driving circuit to a plurality of sub-pixels of a display panel respectively;

disposing a plurality of pixel switches between the output terminal and the plurality of sub-pixels respectively; and the source driving circuit being coupled to a display timing driving circuit and a power control circuit respectively, the display timing driving circuit being coupled to the source driving circuit and a display content detection circuit respectively, the display timing driving circuit changing a driving order according to a display information to control turn-on times of at least two pixel switches overlap each other to drive at least two sub-pixels simultaneously.

10. The display driving method of claim 9, further comprising a step of:

writing a specific voltage to the at least two sub-pixels which are turned on simultaneously according to the display information.

11. The display driving method of claim 9, further comprising a step of:

the power control circuit turning off the power or changing bias voltage or driving strength to reduce power consumption.

12. The display driving method of claim 9, wherein the turn-on times of the at least two pixel switches partially overlap.

13. The display driving method of claim 9, wherein the turn-on times of the at least two pixel switches completely overlap.

14. The display driving method of claim 9, wherein the turn-on times of the plurality of pixel switches overlap each other.

15. The display driving method of claim 9, wherein the display panel comprises a plurality of display areas, the display driving method controls the plurality of display areas to have the same driving timing, and the display timing driving circuit controls turn-on times of at least two pixel switches corresponding to at least two sub-pixels in at least one display area overlap each other.

16. The display driving method of claim 9, wherein the display panel comprises a plurality of display areas, the display driving method controls the plurality of display areas to have different driving timings, and the display timing driving circuit controls turn-on times of at least two pixel switches corresponding to at least two sub-pixels in at least one display area overlap each other.

* * * * *